United States Patent [19]

Liebman

[11] Patent Number: 4,533,145

[45] Date of Patent: Aug. 6, 1985

[54] LIQUID ABSORBING PLAYING PIECE

[76] Inventor: Bradley B. Liebman, Box 703, Germiston 1400, South Africa

[21] Appl. No.: 643,245

[22] Filed: Aug. 22, 1984

[51] Int. Cl.[3] ..... A63F 9/02

[52] U.S. Cl. ..... 273/378; 273/349; 604/361; 604/378

[58] Field of Search ..... 273/349, 378; 604/361, 604/378, 379, 904

[56] References Cited

U.S. PATENT DOCUMENTS

| | | | |
|---|---|---|---|
| 2,772,678 | 12/1956 | Leupold | 604/379 X |
| 3,340,874 | 9/1967 | Burgeni | 604/379 |
| 3,454,344 | 7/1969 | Ryan et al. | 273/378 X |
| 3,486,752 | 12/1969 | Colvin et al. | 273/378 |
| 3,976,075 | 8/1976 | Chinai et al. | 604/379 X |

*Primary Examiner*—Anton O. Oechsle
*Attorney, Agent, or Firm*—Richard L. Miller

[57] ABSTRACT

A playing piece for war game constructed of tissue like materials, which can simulate realistically the damage caused by warfare. Using extremely inexpensive materials, the war game playing pieces may be easily built and then destroyed by the players. The war game playing piece may, for example simulate a ship, in which each of the layers, from the hull, through armored layers, right through to the hull may be simulated by layers of tissue of varying colors. When water shot, for example, by a water pistol in incident upon the simulated ship the water will cause part of the playing piece to become a soggy wad. This material may be pinched away revealing the extent of damage by examination of the colors so revealed. Enumerable games may be constructed around this basic playing piece and various ships, airplanes and vehicles and fixed structures may be simulated in a similar manner.

6 Claims, 8 Drawing Figures

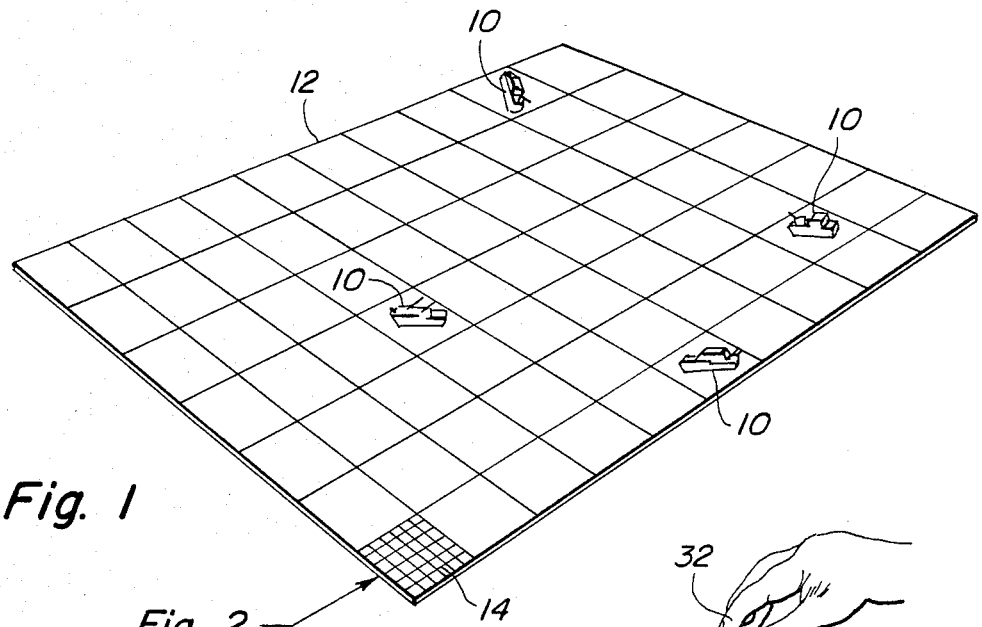
Fig. 1
Fig. 2
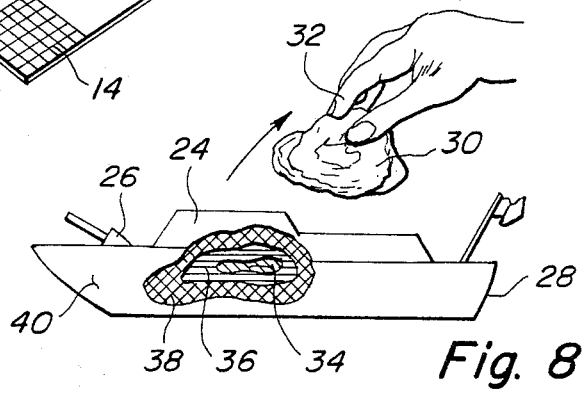
Fig. 8
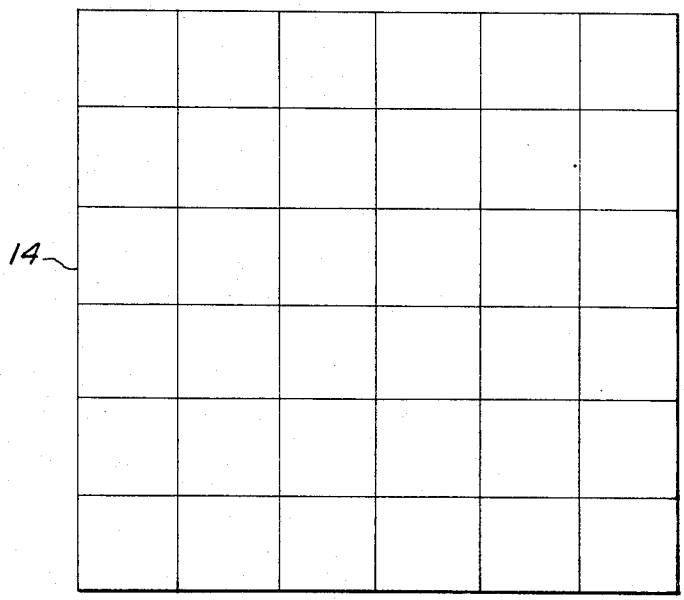
Fig. 2

LIQUID ABSORBING PLAYING PIECE

BACKGROUND OF THE INVENTION

The present invention relates generally to the field of amusement devices and more particularly to the field of games which simulate warfare.

Many of the war games available today do not actually provide the player with a sense of realism due to the fact that they are mostly played on small-scale playing boards. Additionally, no real destruction to the tools of war, such as battleships and airplanes takes place. For this to occur would require an enormous expenditure of money in order to purchase large scale models which would constantly require replacement. There are existing "exploding" models which spring apart when hit, however, they are expensive, unrealistic and do not provide any method of scoring based upon the degree to which they are impacted upon.

SUMMARY OF THE INVENTION

It is therefore a primary object of the present invention to provide a playing piece for war game which is inexpensive enough to permit the continued destruction of playing pieces. To this end, all war game structures are constructed of ordinary toilet tissue, this would include all absorbant (toilet) tissue of all sorts, preferably two-ply, which comes in 10 cm wide rolls.

A further object is to provide a playing piece for war game which are to be manufactured by machinery in a factory and not assembled by players and or others.

A further object is to provide a playing piece for war game which may be "shot down" or "sunk" by using a water pistol, or pieces of tissue paper soaked or impregnated with water in the form of weapons e.g. torpedoes and missiles. When the war playing piece is hit with water, the toilet tissue absorbs the water and the water penetrates to a level defined by the absorptive quality of the tissue structure.

A further object is to provide a playing piece for war game which is constructed in layers so that a "hit" score may be computed according to the number of layers which have been penetrated. The penetrability of layers may be determined by the relative permeability of the tissue, the tightness with which it is rolled and the spacing between helical flattened rolls.

A further object is to provide a playing piece for war game in which each layer is constructed of a different colored permeable material so that as the structure is "hit" the extent of "damage" is easily ascertained by examining the layers which are exposed when the soggy matted material is removed.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the invention showing the game board and some playing pieces, setup and in play.

FIG. 2 is an enlarged view of just one typical square on the game board.

FIG. 8 illustrates a typical ship being examined to determine the extent of damage after being impacted with a liquid in stream form (water pistol) or wetted tissue paper (e.g. torpedo or missile).

DETAILED DESCRIPTION OF THE PREFERRED EMBODIMENTS

Figure 3:
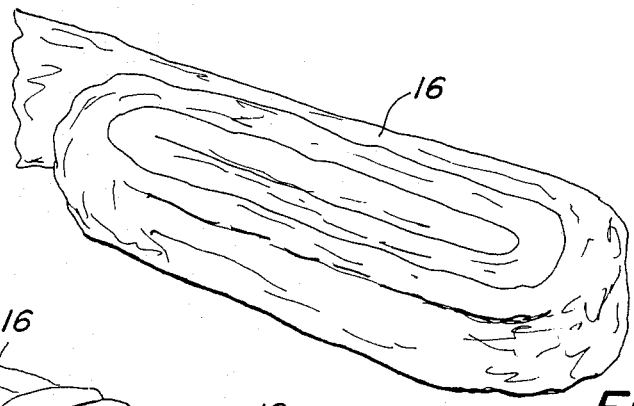
FIGS. 3,4,5,6 and 7 show the sequential steps involved in fabricating the playing pieces.

In FIG. 1, four war game playing pieces typified by 10 are shown placed upon a typical playing board 12. The size of the playing board 12 is scaled to match the size of war game playing pieces typified by 10. Many kinds of board type war games may be devised with different strategies and scoring modes. For example, if a game requires the subdivision of larger squares into a matrix of smaller squares, this may be accomplished as illustrated by a detailed examination of typically subdivided square 14 which is shown in greater detail in FIG. 2.

The structure of the war game playing pieces 10 may best be understood with reference to FIGS. 3 to 7. A permeable absorptive material, such as toilet tissue is rolled longitudinally, as in 16 to form the inner core of the war game 10. The width of this inner core layer 16 determines the height of the war game playing piece 10. The width of this layer, as well as all subsequent layers may be determined by folding over the tissue along its entire length. For example, a 10 cm. wide tissue may be folded in half to form an inner core 5 cm. in height. If a ship was being simulated this inner core might represent the hull of a ship. This layer, as is true for all subsequent layers, may be made to vary in its capacity to absorb water and therefore in its capacity to resist damage when impacted by water shot from a water pistol, or water impregnated tissue weapons (e.g. torpedo and missile). This may be accomplished in three ways. First, the relative permeability of the layer may be varied by varying the density of the permeable material; i.e. the more dense the material the less water penetration damage will occur. Secondly, the tightness of the roll may be varied; i.e. the tighter the roll the less water penetration damage will occur. Thirdly, the spacing between rolls may be varied; i.e. the smaller the spacing between rolls the less water penetration damage will occur.

Figure 4:
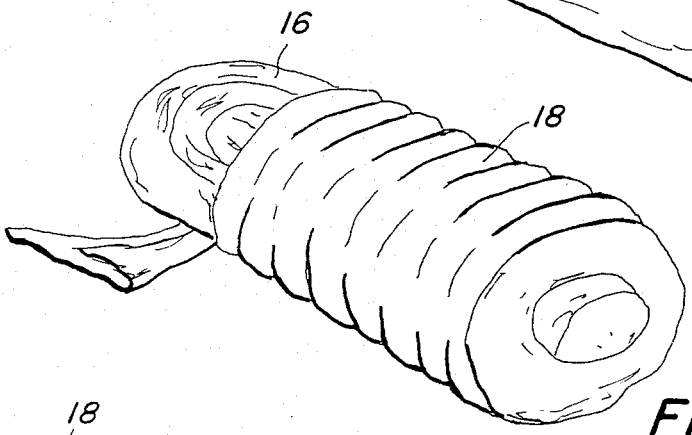
Figure 5:
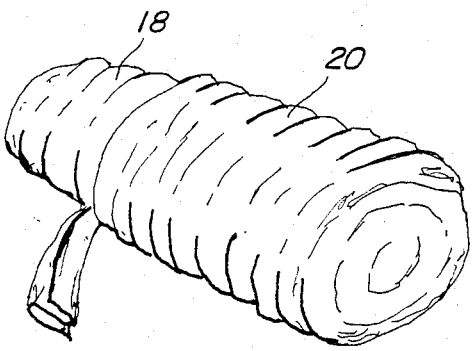

In FIGS. 4 and 5 intermediate layers 18 and 20 are added by wrapping pre-folded tissue around core 16 forming a helical roll running perpendicularly to the major axis of the ellipse formed by the flattened inner core 16. If a ship is being simulated, these intermediate layers may represent layers of armament or plating. As already described, these layers may be made more water absorption proof by, for example, wrapping the layers tighter and eliminating spaces between the coils of the helical rolls.

Figure 6:
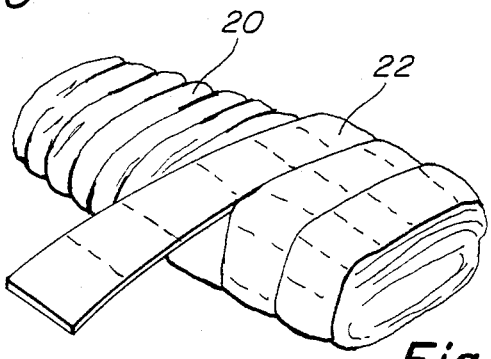
Figure 7:
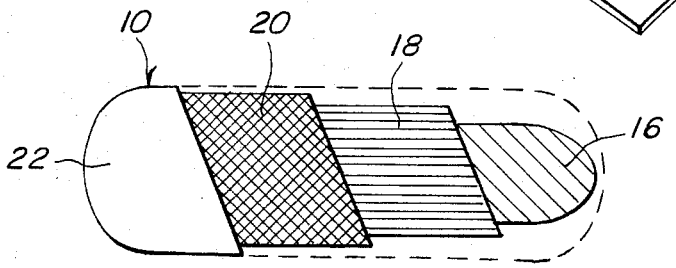

In FIG. 6 an outer layer 22 is added, again by forming a helical roll running perpendicularly to the major axis of the ellipse formed by the flattened inner core 16. If a ship is being simulated, this outer layer 22 may represent the decking of a ship. Since the deck is often quite vulnerable during attack, the simulated deck is wrapped with full-width tissue and is wrapped loosely.

Each of layers 16, 18, 20 and 22 may be variously colored to assist in determining the extent of water penetration and, thereby the extent of damage caused by the attack and a score for the game.

Additional various size rolls of tissue may be added to add the realism of the simulation. For example in FIG. 8 a superstructure 24 and a gun turret 26 have been glued to the main war game structure 28. In this figure the determination of damage and scoring is illustrated. It is assumed that water from a pistol or wetted tissue explosive warhead, (e.g. torpedo, missile) has been incident upon main war game structure 28 on the side facing the viewer. At the point of incidence the water will penetrate main war game playing piece 28 leaving a volume of soggy wadded mass. One of the players, typically the enemy, pinches this mass 30 between fingers 32 and removes it entirely. Due to the nature of soggy wadded toilet tissue this mass is easily removable and dry tissue will be left intact. An examination of the main war game playing piece 28 reveals, by examination of the color of the exposed layers, that damage has been caused to inner layer 34, intermediate layers 36 and 38 and outer layer 40.

Although a ship has been used as an illustrative example, it is understood that almost any war machine or transport may be similarly simulated without departing from the spirit of the invention. For example, airplanes, submarines, tanks, armored vehicles and even fixed structures such as houses and forts may be so constructed.

While certain novel features of this invention have been shown and described and are pointed out in the annexed claims, it will be understood that various omissions, substitutions and changes in the forms and details of the device illustrated and in its operation can be made without departing from the spirit of the invention.

What is claimed is:

1. A playing piece for war game, comprising in combination:

(a) an inner core of permeable absorptive sheet material comprising a longitudinally rolled flattened ellipse wherein said inner core forms a hull structure of said playing piece in a war game;

(b) at least one intermediate layer of permeable absorptive sheet material rolled in layers perpendicular to the major axis of said inner core wherein said intermediate layer forms at least one layer of armor of said playing piece in a war game;

(c) an outer layer of permeable absorptive sheet material rolled in layers perpendicular to the major axis of said inner core wherein said outer layer forms an outer shell of said playing piece in a war game;

(d) means for varying the absorptive capacity of each of said inner core, intermediate and outer layers; and, (e) means for visually identifying the extent to which a liquid incident upon said playing piece in said war game has penetrated said playing piece, thereby providing scoring data.

2. A playing piece for war game, as recited in claim 1, wherein said means for varying the absorptive capacity of each of said inner core, intermediate and outer layers comprises a roll of permeable absorptive sheet material rolled tighter for decreased absorptive capacity and rolled looser for increased absorptive capacity.

3. A playing piece for war game, as recited in claim 1, wherein said means for varying the absorptive capacity of each of said inner core, intermediate and outer layers comprises a roll of permeable absorptive sheet material in which adjacent helical coils comprising each of said layers are more closely spaced for decreased absorptive capacity and are less closely spaced for increased absorptive capacity.

4. A playing piece for war game, as recited in claim 1, wherein said means for varying the absorptive capacity of each of said inner core, intermediate and outer layers comprises a roll of permeable absorptive sheet material in which the density of packing of said permeable absorptive sheet material is greater in areas where less absorptive capacity is desired and where the density of packing is less in areas where more absorptive capacity is desired.

5. A playing piece for war game, as recited in claim 1, wherein said means for visually identifying the extent to which a liquid incident upon said playing piece in said war game has penetrated said playing piece, thereby providing scoring data comprises inner, intermediate and outer layers having a multiplicity of colors whereby when water is incident upon said playing piece, a player may remove the wadded soaked section by grasping said wadded soaked section between said player's fingers thereby exposing the extent to which water has penetrated by exposing color of the innermost layer so exposed and thereby providing scoring data.

6. A playing piece for war game, as recited in claim 1, further comprising auxiliary structures made in an analogous manner to the structure for war game, wherein said auxiliary structures may be attached for added realism, and such structures would mainly include superstructures of models i.e., bridges and mastheads on ships, cannons, missile batteries, turrets, these structures all being constructed out of tissue paper.

* * * * *